United States Patent [19]

Sorenson

[11] Patent Number: 4,853,505

[45] Date of Patent: Aug. 1, 1989

[54] MINIATURE ILLUMINATED ROCKER SWITCH

[75] Inventor: Richard W. Sorenson, Avon, Conn.

[73] Assignee: Carlingswitch, Inc., West Hartford, Conn.

[21] Appl. No.: 165,744

[22] Filed: Mar. 9, 1988

[51] Int. Cl.[4] ..... H01H 9/16

[52] U.S. Cl. ..... 200/315; 200/457; 200/458

[58] Field of Search ..... 200/315, 316, 317, 314, 200/310–313

[56] References Cited

U.S. PATENT DOCUMENTS 3,238,343 3/1966 Carlson ..... 200/313
4,095,067 6/1978 LaScola ..... 200/317

FOREIGN PATENT DOCUMENTS 2904859 9/1980 Fed. Rep. of Germany ..... 200/315
3306219 8/1984 Fed. Rep. of Germany ..... 200/310

*Primary Examiner*—Renee S. Luebke
*Attorney, Agent, or Firm*—McCormick, Paulding & Huber

[57] ABSTRACT

A generally cylindrical lamp of diameter D is provided in a miniature double pole switch case of internal height only 2×D. The movable contact levers are shorter than the length of the switch case cavity and an internal divider wall cooperates with skirt portions of the rocker to support these levers during pivotal movement on the upper ends of the center fixed contacts. The levers are spaced apart at least approximately by the dimension D.

6 Claims, 3 Drawing Sheets

MINIATURE ILLUMINATED ROCKER SWITCH

SUMMARY OF THE INVENTION

This invention relates generally to miniature illuminated double pole electrical switches, and deals more particularly with a miniature double pole electrical switch with selectively illuminated rocker/actuator.

In accordance with the present invention a miniature switch is provided with an upwardly open molded plastic case or base in which the bottom wall is integrally connected to the front, rear and end walls to define an upwardly open cavity. The molded base also has an internal integrally formed divider wall provided between the front and the rear walls of the case to provide front and rear cavities for two contact levers. The fixed center contact terminals are provided in aligned center slots in the bottom wall and support these movable contact levers on edge between the divider wall and depending skirt portions of the rocker actuator. Each movable contact lever has a free end for engaging the upper end of an associated fixed contact adjacent one end of the case, and the opposite end of each movable contact lever defines a pivoted end supported on the center fixed contact associated with it. Thus, the contact levers are relatively short and arranged on one side of their associated cavities. The shortened movable contacts provide sufficient space on the opposite side of the switch case cavity to house an electrical lamp that is mounted in the case in a receptacle defined for it by the divider wall. The lamp has a diameter D that is at least approximately equal to the lateral spacing between the movable contact levers. The movable contact levers are engaged by spring means acting between the rocker and a land defined by each lever above its pivoted end. As so constructed and arranged the rocker achieves pivotal movement of both contact levers in unison to achieve opening and closing of the switch contacts while nevertheless allowing sufficient room for the relatively large lamp means provided in the other side of the miniature switch case itself. A resistor may be provided between the contact levers again in centered relationship with regard to the divider wall and the divider wall includes suitable slots for receiving conductive leads from the lamp to facilitate assembly of the lamp and resistor in the switch case. The resistor is preferably provided in a downwardly open recess in the switch case bottom wall and is also held in place by a tang on at least one of the center fixed contacts or terminals projecting below the bottom wall of the case. The resistor comprises a simple wire wound type with metal end caps and does not include lead wires and/or a plastic covering of the type normally provided with resistors generally. The fixed end contacts of the switch and the center fixed contacts are formed from initially flat stock, and the upper ends of the end fixed contacts are shaped to support a precious metal contact area for engagement by the free end of the movable contact levers.

DETAILED DESCRIPTION OF THE DRAWINGS

Figure 1:
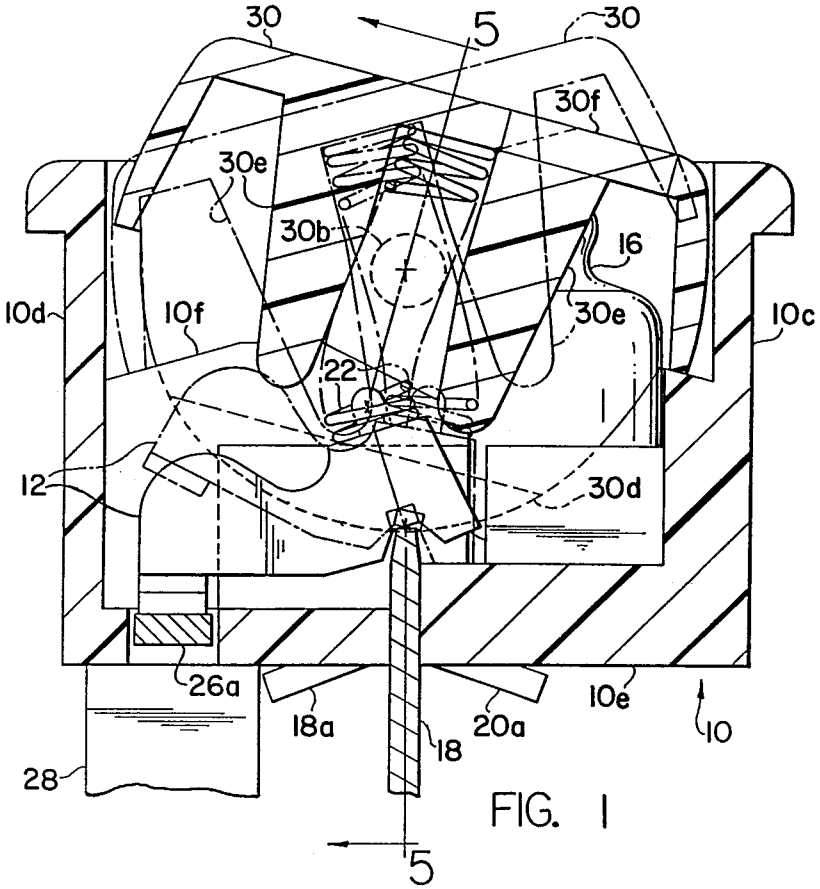
FIG. 1 is a vertical sectional view taken generally on the line 1—1 of FIG. 2 and shows a selectively illuminated rocker switch incorporating the present invention. Two positions for the rocker and contact are shown in full and in broken lines.
Figure 4:
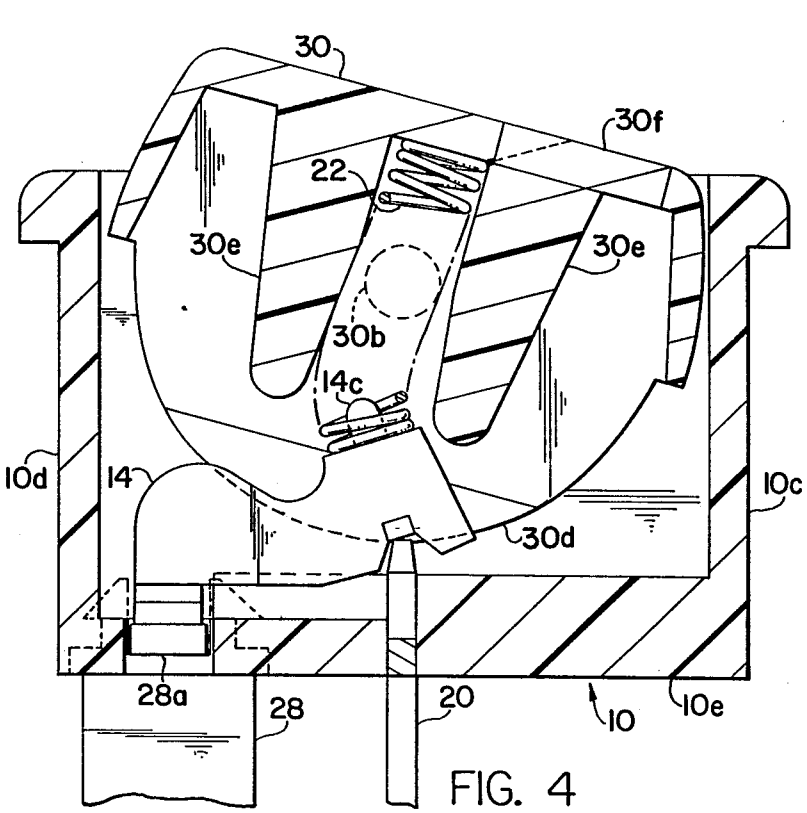
FIG. 4 is a sectional view taken generally on the line 4—4 of FIG. 2.

Turning now to the drawings in greater detail, FIG. 1 shows a miniature rocker switch of the type adapted to fit into a rectangular panel mounting hole (not shown). The size of this switch configuration is such that a typical panel opening might be approximately 0.75 inches×0.50 inches to receive such a miniature switch. In the double pole switch configuration shown in FIGS. 1 and 2 a molded plastic case or switch base 10 has front and rear walls 10*a* and 10*b* integrally connected to end walls 10*c* and 10*d*, all of which walls are in turn integrally connected to a bottom wall 10*e*. Still with reference to the switch case or base 10 an integrally defined center divider wall best shown in FIG. 3 at 10*f* is provided midway between the front and rear walls 10*a* and 10*b* to define separate cavities for the movable contact levers 12 and 14 respectively.

Figure 2:
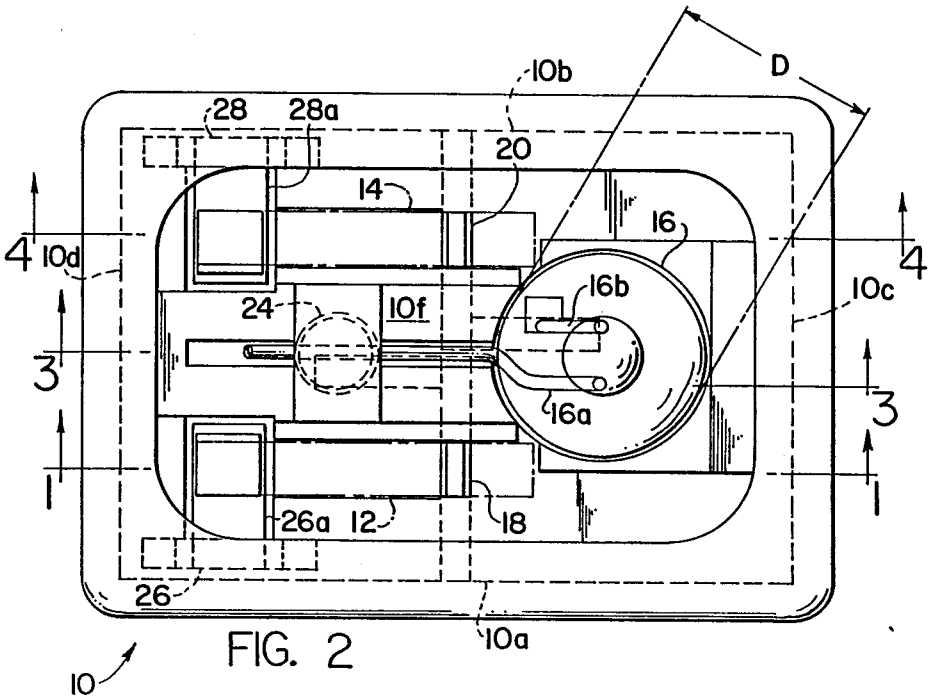
FIG. 2 is a horizontal plan view of the switch illustrated in FIG. 1 but with the rocker and associated contact lever engaging springs being omitted so as to better illustrate the arrangement for the lamp and contact levers inside the switch case.
Figure 3:
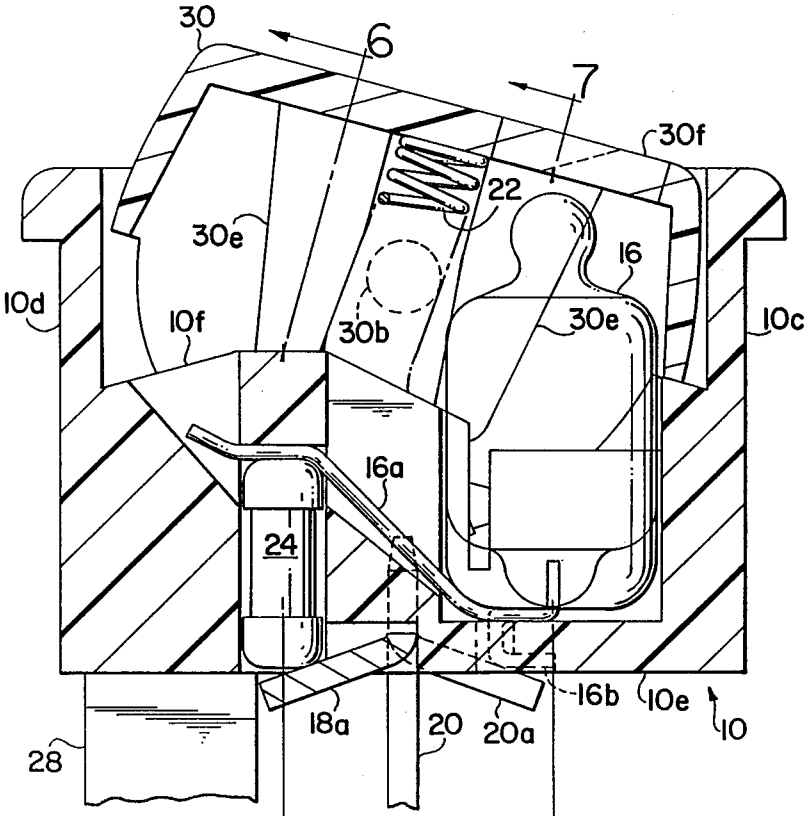
FIG. 3 is a vertical sectional view of the switch illustrated in FIG. 2 being taken generally on the line 3—3 of that view.

As best shown in FIG. 2 these contact levers 12 and 14 are guided by front and rear surfaces of the center divider wall 10*f* during movement of the contact levers between the solid and broken line positions as suggested by the contact lever 12 in FIG. 1. FIG. 2 also shows that these contact levers 12 and 14 are spaced apart from one another by a distance approximately equal to the diameter D of the electrically energizable lamp 16 that is provided in an opening defined for this purpose in the center divider wall 10*f*. As illustrated in FIG. 3 this lamp or bulb 16 has a height of approximately twice its diameter D so as to occupy substantially the entire vertical internal height for the upwardly open switch case cavity.

FIG. 3 also shows the lamp means 16 as including two conductive leads 16*a* and 16*b*, the first of which 16*a* is received in a slot provided for it in the center divider wall 10*f*. The second lead 16*b* extends downwardly through an opening in the bottom wall 10*e* of the case 10 where it is electrically connected to and held in place by a tab 20*a* on one of two center fixed contacts or terminals 18 and 20. FIG. 3 also shows an oppositely bent tang 18*a* on the front fixed terminal 18 that serves to make electrical contact with one end of a resistor element 24 and to hold the resistor element 24 in place. The opposite end of the resistor element 24 engages the conductive lead 16*a* associated with the lamp 16. Thus, the lamp and the resistor element are provided in series circuit with the two center terminals 18 and 20, and by means of the two movable contacts 12 and 14 this circuit can be conveniently opened and closed depending upon the position of these movable contact levers as dictated by pivotal movement of actuator 30.

Figure 5:
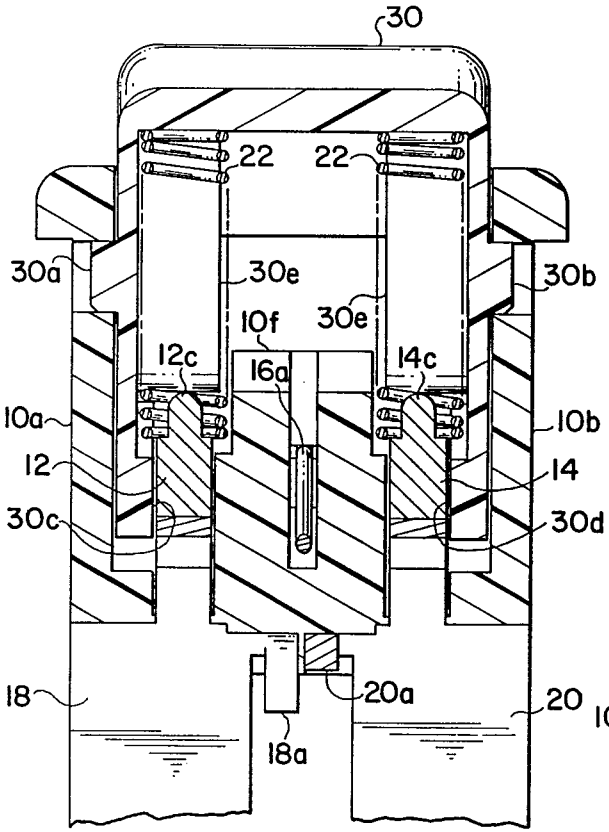
FIG. 5 is a vertical section taken generally on the line 5—5 of FIG. 1.

The actuator 30 is preferably provided in the form of a pivotably mounted rocker having aligned axle defining portions 30*a* and 30*b* received in aligned openings provided for this purpose in the front and rear walls 10*a* and 10*b* of the case 10. FIG. 5 shows this geometry at its best advantage and also illustrates two coil compression springs 22, 22 that define spring biasing means to urge the movable contacts 12 and 14 downwardly into contact with the upper ends of the center fixed contacts 18 and 20, and depending upon rocker position, into contact with the fixed end contacts 26 and 28. As shown in FIG. 2 each of these fixed end contacts 26 and 28 has an inturned laterally bent upper end portion 26*a* and 28*a* that is provided below the free end portions of the movable contact levers 12 and 14 for this purpose.

Figure 6:
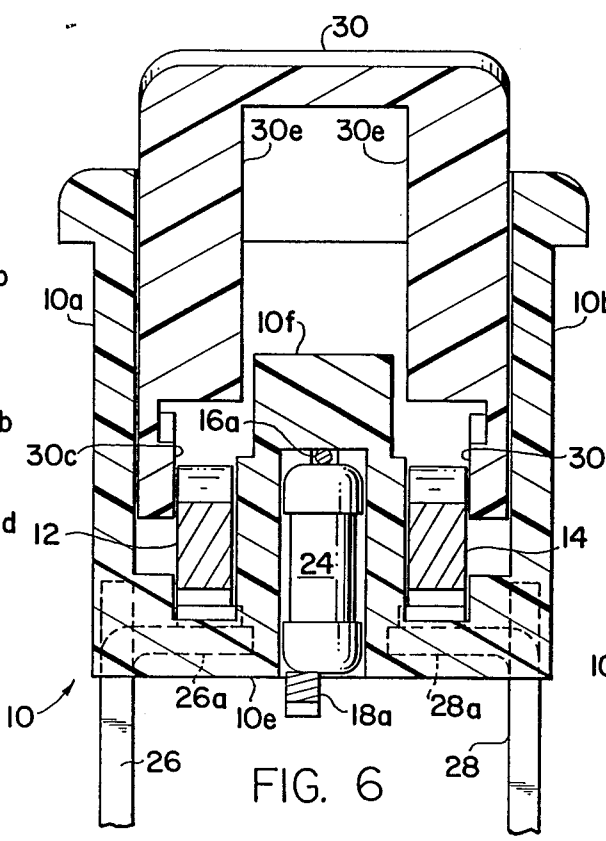
FIG. 6 is a vertical section taken generally on the line 6—6 of FIG. 3.

FIG. 6 shows this configuration for the fixed end contact 26, 28 and also illustrates the free end portions of the movable contact levers 12 and 14 in abutting relationship thereto. This position for the switch (closed) as illustrated in FIGS. 5 and 6, also shows the generally upright configuration for the contact levers 12 and 14. Each lever 12 and 14 comprises a formed metal member of overall length only slightly greater than one-half the length of the switch case cavity, as suggested in FIG. 1, and each said contact lever 12 and 14 has a generally rectangular cross sectional configuration so that when supported at one end, its pivoted end, on a center fixed contact, as for example contact 18 in FIG. 1, the lever 12 is held in upright configuration by the front and rear surfaces of the center divider wall 10*f* and by depending skirt portions 30*c* and 30*d* of the rocker actuator 30. As so constructed and arranged movement of the rocker 30 between the two positions shown in FIG. 1 can be accomplished as follows. The coil springs 22 act between the underside of the rocker and a land defining portion of each movable contact levers 12 and 14 located above the pivoted end portion of the contact lever as best shown in FIG. 1. This land against which the coil spring acts can be seen to move in an arc relative the upper end of the fixed contact 18 so as to achieve a stable position for the contact lever and hence for the rocker in both the two switch positions shown. FIG. 5 illustrates the coil springs 22, 22 and the raised land defining area of the contact lever around a spring locating post 12*c* and 14*c* of each of these contact levers 12 and 14. The coil springs 22, 22 are held in place at least within the rocker 30 by depending fingers 30*e*, 30*e* that cooperate with the depending skirts 30*c*, 30*d* for this purpose, all as referred to previously. The springs 22 actually project beyond these fingers 30*e* and this allows freedom of lateral movement for the lower end of the springs 22 as referred to previously to achieve the desired degree of movement of the contact lever 12 between the limit positions shown in FIG. 1.

Figure 7:
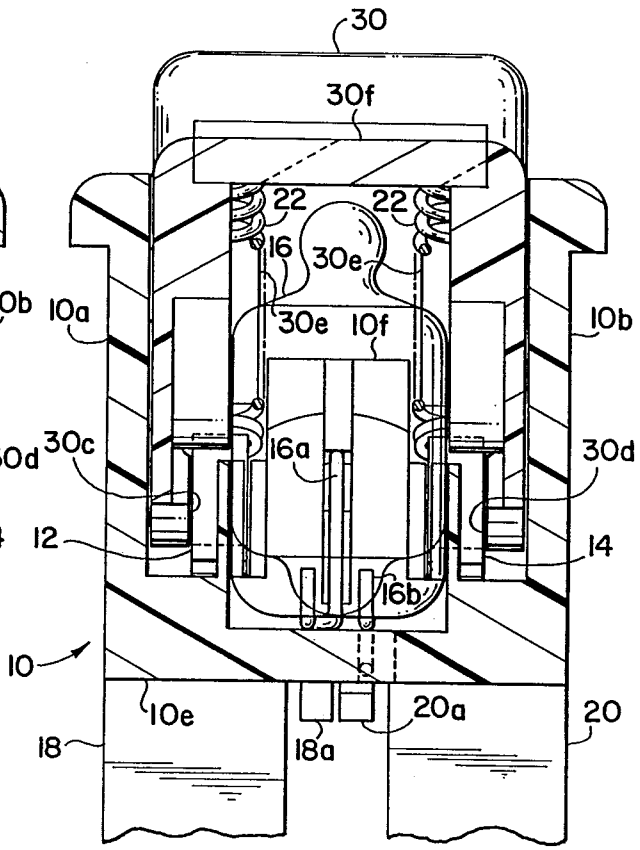
FIG. 7 is a vertical section taken generally on the line 7—7 of FIG. 3.

As so constructed and arranged a single relatively large lamp 16 can be provided in a relatively small miniature switch case so as to selectively illuminate a rocker 30, and more particularly pass light through a window portion 30*f* defined for this purpose in the top surface of the rocker 30 as suggested in FIG. 7. With a terminal configuration such as shown in FIGS. 1–7 supply voltage is imposed across a center and an end contact not in the same pole. The other center contact and the lamp will be selectively energizable by movement of the rocker as described above. Alternatively, a fifth fixed terminal might be provided opposite the two end terminals to provide a continuously energized lamp if desired.

I claim:

1. A miniature double pole electrical switch with lighted actuator, said switch comprising an upwardly open molded plastic case having a bottom wall and integrally connected front, rear, and end walls, said switch case having an integrally formed divider wall between said front and rear walls to provide front and rear cavities inside said case, at least two fixed center contact terminals provided in aligned center slots in said bottom wall, said center terminals having upper end portions located in said front and rear switch case cavities, movable contacts provided in said front and rear cavities, each movable contact having a pivoted end supported on one of said fixed contact terminal upper ends, each movable contact having a free end, each movable contact defining a land spaced above said pivoted end and above said fixed contact terminal upper end, an actuator movably mounted in said case, spring means provided in part in said actuator and having parts acting on said movable contact lands to pivot said movable contacts in response to actuator movement, at least two fixed end terminals adjacent one end wall of said molded case, said two fixed end terminals having upper ends engageable by said movable contact free ends in a closed condition for said switch actuator, a lamp provided adjacent an end of said molded case opposite said one end, said lamp provided in part in said front and said rear cavities and having first and second conductive leads, said divider wall having an opening to receive said lamp, each of said center fixed contacts having an integrally formed tang, one tang being bent in a direction to electrically connect its associated terminal to said first conductive lamp lead, said divider wall and case bottom wall defining a downwardly open resistor receptacle, said divider wall defining a slot for receiving said second conductive lamp lead, said slot having a portion in communication with said resistor receptacle, a resistor held in said receptacle by said tang on the other of said center fixed contact terminals.

2. The combination of claim 1 wherein said lamp is of generally cylindrical shape with a diameter D and a height $2 \times D$, said movable contacts being spaced apart at least by said dimension D.

3. The combination of claim 2 wherein said actuator comprises a rocker pivotably mounted in said upwardly open case, said rocker having a top defining a window for emitting light from said lamp, said rocker having front and rear skirt portions defining spring supporting recesses, said spring means comprising two coil springs, said coil springs having upper ends provided in said supporting recesses of said rocker skirt portions, said spring means in part comprising lower ends of said coil springs, said lands comprising spring locating lugs on said movable contacts.

4. The combination of claim 3 wherein said movable contacts comprise vertically oriented generally flat levers of limited lateral dimension slidably supported between said rocker skirt portions and said divider wall so as to remain in the same plane as they pivot between open and closed positions corresponding to switch open and switch closed conditions respectively.

5. The combination of claim 4 wherein said fixed contact terminals comprise vertically oriented generally flat terminal strips, said center fixed terminals being in a common vertical plane and said tangs being bent out of said plane in opposite directions.

6. The combination of claim 5 wherein said at least two fixed end terminals comprise vertically oriented generally flat terminals oriented in parallel planes that are perpendicular to said common vertical plane of said center fixed contact terminals, and upper end portions of said end terminals bend toward one another to define areas for abutment by said movable contact lever free ends.

* * * * *